US006767410B2

(12) United States Patent
Aubay et al.

(10) Patent No.: US 6,767,410 B2
(45) **Date of Patent: *Jul. 27, 2004**

(54) USE OF AN AMPHOTERIC POLYMER TO TREAT A HARD SURFACE

(75) Inventors: Eric Aubay, Le Perreux sur Marne (FR); Dominic Yeung, Mississauga (CA)

(73) Assignee: Rhodia Chimie, Boulogne Billancourt (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/445,605

(22) Filed: May 27, 2003

(65) Prior Publication Data

US 2003/0203826 A1 Oct. 30, 2003

Related U.S. Application Data

(63) Continuation of application No. 10/207,303, filed on Jul. 29, 2002, now Pat. No. 6,593,288, which is a continuation of application No. 09/596,586, filed on Jun. 19, 2000, now abandoned.

(30) Foreign Application Priority Data

Jul. 15, 1999 (FR) ..... 99 09183

(51) Int. Cl.[7] ..... B08B 3/04; C11D 1/83; C11D 1/65; C11D 1/37

(52) U.S. Cl. ..... 134/42; 510/180; 510/181; 510/237; 510/238; 510/426; 510/427; 510/499; 510/503; 510/504; 510/433; 510/476

(58) Field of Search ..... 510/237, 238, 510/180, 181, 426, 427, 499, 503, 504, 433, 476; 134/42

(56) References Cited

U.S. PATENT DOCUMENTS 6,593,288 B2 * 7/2003 Aubay et al. ..... 510/504

* cited by examiner

*Primary Examiner*—Gregory R. Del Cotto

(57) ABSTRACT

This invention relates to the use of a water-soluble or water-dispersible copolymer comprising, in the form of polymerized units:

(a) at least one monomer compound of general formula I:

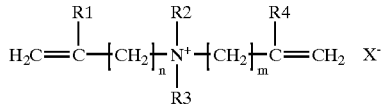

(b) at least one hydrophilic monomer bearing a function of acidic nature which is copolymerizable with (a) and capable of ionizing in the application medium, (c) optionally, at least one hydrophilic monomer compound containing ethylenic unsaturation and of neutral charge, bearing one or more hydrophilic groups, which is copolymerizable with (a) and (b), the a/b molar ratio being between 60/40 and 5/95, to give a hard surface hydrophilic properties.

8 Claims, No Drawings

USE OF AN AMPHOTERIC POLYMER TO TREAT A HARD SURFACE

This application is a continuation application Ser. No. 10/207,303, filed on Jul. 29, 2002, now U.S. Pat. No. 6,593,288, which is a continuation of U.S. application Ser. No. 09/596,586, filed in Jun. 19, 2000 now abandoned.

The present invention relates to the cleaning of public, domestic or industrial hard surfaces, in particular of ceramic, tile or glass type, which is aimed at giving these surfaces hydrophilic properties.

The invention relates more particularly to the use of polymers having both properties of interaction with the hard surface and hydrophilic properties to give this surface long-lasting hydrophilic properties so as to avoid the subsequent presence of marks due in particular to the drying of droplets of water deposited on said surface.

Commercial detergent formulations clean public, domestic or industrial hard surfaces efficiently. They generally consist of an aqueous solution of surfactants, in particular of nonionic and anionic surfactants, of alcohol(s) to facilitate drying, and optionally of sequestering agents and bases to adjust the pH. A major defect of these detergent formulations is that the subsequent contact of the hard surface with the skin can lead to the presence of marks on drying. This contact with water after applying detergent can originate, for example, from rainwater in the case of windows, mains water on a bathroom tile, or rinsing water when the cleaning requires a rinsing. They can also originate from the air-drying of washing-up crockery in the case of detergent formulations for washing up by hand, or from the drying of washing-up crockery in an automatic machine when it is a case of dishwasher detergent. In the case of doing the washing up in an automatic machine, said formulation can either be used in the cleaning cycle (detergent formulation) or during the rinsing cycle (rinsing liquid).

The presence of marks or stains left on hard surfaces by water which comes into contact with them is due to the phenomenon of contraction of the drops of water on contact with the hard surface, which, during the subsequent drying, leave marks on the surface which reproduce the original shapes and dimensions of the drops.

No satisfactory solution to this problem exists at the present time.

To solve the problem posed by the retraction and drying of drops of water, the solution consists in increasing the hydrophilicity of the surface in order to obtain the smallest possible contact angle between the hard surface to be treated and the drop of water.

The inventors' studies which led to the present invention have determined that this problem can be solved in an effective and long-lasting manner by incorporating a water-soluble or water-dispersible organic polymer compound which has both a function of interaction with the surface to be treated and a function giving this surface a hydrophilic nature into conventional compositions for cleaning hard surfaces.

EP 522 756 describes ampholytic terpolymers comprising, as polymer units:

- a cationic monomer, in particular dimethyldiallylammonium chloride (DADMAC for diallyldimethylammonium chloride);
- an anionic monomer, in particular acrylic acid;
- a nonionic monomer, in particular acrylamide.

These terpolymers have moisturizing and protective properties on the skin and the nails and are provided in compositions intended to be applied to the skin, such as aftershaves, sunscreens, hand lotions, liquid soaps, bath products and shaving foams. The document also describes a composition for doing the washing up by hand, this composition being particularly suitable for protecting and moisturizing the skin.

WO 97/22 640 describes aqueous dispersions of polymers with surfactant properties and more particularly foaming properties.

The polymers are prepared by polymerization of vinyl monomers (a) containing at least one quaternary nitrogen atom with vinyl monomers (b) containing at least one amide group and vinyl monomers (c) containing both hydrophilic and hydrophobic groups, so as to give the terpolymer detergent properties.

A monomer (a) which is mentioned in particular is DADMAC.

A monomer (b) which is mentioned in particular is (meth)acrylamide.

The monomers (c) are polyethoxylated and polypropoxylated derivatives of a carboxylic acid, such as acrylic acid.

EP 835 925 describes a detergent composition for doing the washing up in an automatic dishwasher, comprising a lipolytic enzyme and a copolymer obtained by polymerization of 50 mol % to 99 mol % of anionic monomer units, in particular of acrylic acid, with 1 mol % to 50 mol % of cationic monomers, in particular DADMAC and 0 mol % to 25 mol % of an anionic, cationic, amphoteric or nonionic monomer or a mixture thereof, in particular acrylic acid esters.

The combination of the lipolytic enzyme with the polymer avoids the deposition of calcium soap on the washing-up crockery without having harmful effect on the grease-removing action by the lipases.

It has been proposed (JP 09-169 995-A) to use, in compositions for treating toilet pans against soiling, a cationic polymer for increasing the hydrophilicity of the surface to be treated. Examples of cationic polymers which are mentioned are DADMAC homopolymers and copolymers of DADMAC and of acrylamide, as well as copolymers of DADMAC and of acrylic acid; the polymers mentioned as being preferred are the copolymers of DADMAC and of acrylic acid with a DADMAC/acrylic acid weight ratio of 8/2 and most preferably the DADMAC homopolymers.

The Applicant has found, contrary to what the above document suggests, that a markedly higher permanent hydrophilicity of the treated surface is found when higher levels of anionic monomer are present.

The studies by the inventors which have led to the present invention have determined that the copolymers obtained by copolymerization of monomers containing a quaternary ammonium function and two groups containing ethylenic unsaturation with monomers containing a group capable of ionizing in the application medium to form anionic units, with a ratio of the first monomers to the second monomers which is within a given range, give hard surfaces noteworthy hydrophilic properties.

A first subject of the invention consists in using a water-soluble or water-dispersible copolymer comprising, in the form of polymerized units:

(a) at least one monomer compound of general formula I:

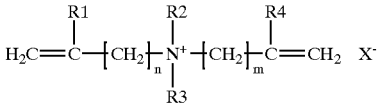

in which:

$R_1$ and $R_4$, independently of each other, represent a hydrogen atom or a linear or branched $C_1$-$C_5$ alkyl group;

$R_2$ and $R_3$, independently of each other, represent an alkyl, hydroxyalkyl or aminoalkyl group in which the alkyl group is a linear or branched $C_1$-$C_5$ chain, preferably a methyl group;

n and m are integers between 1 and 3;

X, which may be identical or different, represent counterions which are compatible with the water-soluble or water-dispersible nature of the polymer;

(b) at least one hydrophilic monomer bearing a function of acidic nature which is copolymerizable with (a) and capable of ionizing in the application medium, (c) optionally, at least one hydrophilic monomer compound containing ethylenic unsaturation and of neutral charge, bearing one or more hydrophilic groups, which is copolymerizable with (a) and (b), in which the a/b molar ratio is between 60/40 and 5/95, to give a hard surface hydrophilic properties.

Preferably, $R_1$ represents hydrogen, $R_2$ represents methyl, $R_3$ represents methyl, $R_4$ represents hydrogen, and m and n are equal to 1.

The ion $X^-$ is advantageously chosen from halogen, sulfate, hydrogen sulfate, phosphate, citrate, formate and acetate.

The monomer (a) gives the copolymer properties of interaction with the surface to be treated, in particular allowing anchoring of the copolymer to this surface.

The monomer (b) and optionally the monomer (c) give the copolymer hydrophilic properties which, after anchoring the copolymer to the surface to be treated, are transmitted to this surface.

This hydrophilic property of the surface moreover reduces the formation of mist on the surface; this benefit can be exploited in particular in cleaning formulations for glass panels and mirrors, in particular in bathrooms.

The copolymer according to the invention advantageously has a molecular mass of at least 1000, advantageously of at least 10,000; it can be up to 20,000,000, advantageously up to 10,000,000.

Except where otherwise indicated, when a molecular mass is mentioned, this will be the weight-average molecular mass, expressed in g/mol.

This can be determined by aqueous gel permeation chromatography (GPC) or by measuring the intrinsic viscosity in a 1N $NaNO_3$ solution at 30° C.

The copolymer is preferably a random copolymer.

The monomer (a) preferably has the following structure:

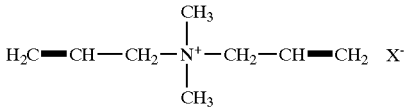

$X^-$ being as defined above.

One monomer which is particularly preferred is that of the above formula in which $X^-$ represents $Cl^-$, this monomer being known as DADMAC.

The monomers (b) are advantageously water-soluble $C_3$-$C_8$ carboxylic, sulfonic, sulfuric, phosphonic or phosphoric acids containing monoethylenic unsaturation, anhydrides thereof and water-soluble salts thereof.

Among the preferred monomers (b) which may be mentioned are acrylic acid, methacrylic acid, α-ethacrylic acid, β,β-dimethacrylic acid, methylenemalonic acid, vinylacetic acid, allylacetic acid, ethylideneacetic acid, propylideneacetic acid, crotonic acid, maleic acid, fumaric acid, itaconic acid, citraconic acid, mesaconic acid, N-methacryloylalanine, N-acryloylhydroxyglycine, sulfopropyl acrylate, sulfoethyl acrylate, sulfoethyl methacrylate, sulfoethyl methacrylate, styrenesulfonic acid, vinylsulfonic acid, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate and phosphonopropyl methacrylate, and the ammonium and alkali metal salts of these acids.

Among the monomers (c) which may be mentioned are acrylamide, vinyl alcohol, $C_1$-$C_4$ alkyl esters of acrylic acid and of methacrylic acid, $C_1$-$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters.

The monomer (a) content is advantageously between 5 mol % and 60 mol %, preferably 20 mol % to 50 mol %.

The monomer (b) content is advantageously between 10 mol % and 95 mol %, preferably 20 mol % to 80 mol %.

The monomer (c) content is advantageously between 0 mol % and 50 mol %, preferably 5 mol % to 30 mol %.

The a/b molar ratio is preferably between 50/50 and 10/90.

The copolymers of the invention can be obtained according to the known techniques for preparing copolymers, in particular by radical-mediated polymerization of the ethylenically unsaturated starting monomers which are known compounds or which can readily be obtained by a person skilled in the art using conventional synthetic processes of organic chemistry.

The radical-mediated polymerization is preferably carried out in an oxygen-free environment, for example in the presence of an inert gas (helium, argon, etc.) or nitrogen. The reaction is carried out in an inert solvent, preferably methanol or ethanol, and more preferably in water.

The polymerization is initiated by adding a polymerization initiator. The initiators used are the free-radical initiators usually used in the art. Examples comprise organic peresters (t-butyl peroxypivalate, t-amyl peroxypivalate, t-butyl peroxy-α-ethylhexanoate, etc.); organic compounds of azo type, for example azobisamidinopropane hydrochloride, azobisisobutyronitrile, azobis(2,4-dimethylvaleronitrile, etc.); inorganic and organic peroxides, for example hydrogen peroxide, benzyl peroxide and butyl peroxide, etc; redox initiator systems, for example those comprising oxidizing agents, such as persulfates (in particular ammonium or alkali metal persulfates, etc.); chlorates and bromates (including inorganic or organic chlorates and/or bromates); reducing agents such as sulfites and bisulfites (including inorganic and/or organic sulfites or bisulfites); oxalic acid and ascorbic acid, as well as mixtures of two or more of these compounds.

The preferred initiators are water-soluble initiators. Sodium persulfate and azobisamidinopropane hydrochloride are particularly preferred.

As a variant, the polymerization can be initiated by irradiation with ultraviolet light. The amount of initiators used is generally an amount which may be sufficient for initiating the polymerization. The initiators are preferably present in an amount ranging from 0.001% to approximately 10% by weight relative to the total weight of the monomers, and are preferably in an amount of less than 0.5% by weight relative to the total weight of the monomers, a preferred amount being in the range from 0.005% to 0.5% by weight relative to the total weight of the monomers. The initiator is added to the polymerization mixture in a continuous or batchwise manner.

When it is desired to obtain copolymers of high molecular mass, it is desirable to add the fresh initiator during the polymerization reaction. Gradual or batchwise addition also allows a more efficient polymerization and a shorter reaction time. The polymerization is carried out under reaction conditions that are effective for polymerizing the monomers (a), the monomers (b) and optionally the monomers (c) in an oxygen-free atmosphere. The reaction is preferably carried out at a temperature ranging from about 30° C. to about 100° C. and preferably between 60° C. and 90° C. The oxygen-free atmosphere is maintained throughout the reaction, for example by maintaining a flush of nitrogen throughout the reaction.

The following copolymers are most particularly preferred:

DADMAC/acrylic acid/acrylamide copolymer;

DADMAC/maleic acid copolymer;

DADMAC/sulfonic acid copolymer;

the DADMAC/acidic monomer molar ratio being between 60/40 and 5/95, preferably between 50/50 and 10/90.

The copolymers of the invention are useful for giving hydrophilic properties to surfaces to which they are applied, in particular for giving surfaces long-lasting stain-resistant or mark-resistant properties, as well as anti-misting properties.

The expression "long-lasting stain-resistant or mark-resistant properties" means that the treated surface maintains these properties over time, which includes after subsequent contact with water, whether this is rainwater, mains water or rinsing water containing or not containing rinsing products.

The copolymers described above are particularly advantageous in compositions for cleaning hard surfaces.

The cleaning composition according to the invention intended to treat hard surfaces comprises at least one copolymer as described above at a content of between 0.001% and 10% by weight relative to the total weight of the composition, depending on the concentration of active ingredients therein.

The copolymers of the invention are intended to be incorporated into compositions for doing the washing up in a dishwasher or by hand, or for cleaning glass panels, ceramics such as bathrooms, sinks, motor vehicle bodyworks, shower walls, toilet pans and glass-ceramic plates.

The composition according to the invention also generally comprises at least one surfactant. This is advantageously an anionic and/or nonionic surfactant.

The composition according to the invention generally comprises at least one surfactant. This is advantageously an anionic and/or nonionic surfactant. It can also be a cationic, amphoteric or zwitterionic surfactant.

Among the anionic surfactants which may be mentioned in particular are soaps such as salts of $C_8$-$C_{24}$ fatty acids, for example salts of fatty acids derived from coconut and from tallow; alkylbenzenesulfonates, in particular alkylbenzenesulfonates of a linear $C_8$-$C_{13}$ alkyl in which the alkyl group comprises from 10 to 16 carbon atoms, alcohol sulfates, ethoxyalted alcohol sulfates, hydroxylalkyl sulfonates; alkyl sulfates and sulfonates, in particular of $C_{12}$-$C_{16}$ alkyl, monoglyceride sulfates, and condensates of fatty acid chlorides with hydroxyalkylsulfonates.

Anionic surfactants that are advantageous are, in particular:

- alkylester sulfonates of formula R—CH(SO—M)—COOR', in which R represents a $C_6$-$C_{20}$, preferably $C_{12}$-$C_{16}$, alkyl radical, R' represents a $C_1$-$C_6$, preferably $C_1$-$C_3$, alkyl radical and M represents an alkali metal (sodium, potassium or lithium) cation, a substituted or unsubstituted ammonium (methyl-, dimethyl-, trimethyl-, tetramethylammonium, dimethylpiperidinium, etc.) or an alkanolamine (monoethanolamine, diethanolamine, triethanolamine, etc.) derivative. Mention may be made most particularly of methyl ester sulfonates in which the radical R is $C_{14}$-$C_{16}$;
- alkyl sulfates of formula $ROSO_3M$, in which R represents a $C_5$-$C_{24}$, preferably $C_{10}$-$C_{18}$, alkyl or hydroxyalkyl radical, M representing a hydrogen atom or a cation of the same definition as above, as well as the ethoxylenated (EO) and/or propoxylenated (PO) derivatives thereof containing on average from 0.5 to 30 and preferably from 0.5 to 10 EO and/or PO units;
- alkylamide sulfates of formula $RCONHR'OSO_3M$, in which R represents a $C_2$-$C_{22}$, preferably $C_6$-$C_{20}$, alkyl radical, R' represents a $C_2$-$C_3$ alkyl radical, M representing a hydrogen atom or a cation of the same definition as above, as well as the ethoxylenated (EO) and/or propoxylenated (PO) derivatives thereof, containing on average from 0.5 to 60 EO and/or PO units;
- salts of saturated or unsaturated $C_8$-$C_{24}$, preferably $C_{14}$-$C_{20}$, fatty acids, $C_9$-$C_{20}$ alkylbenzenesulfonates, primary or secondary $C_8$-$C_{22}$. alkylsulfonates, alkylglyceryl sulfonates, the sulfonated polycarboxylic acids described in GB-A-1 082 179, paraffin sulfonates, N-acyl N-alkyltaurates, alkylphosphates, isethionates, alkylsuccinamates, alkylsulfosuccinates, sulfosuccinate monoesters or diesters, N-acyl sarcosinates, alkylglycoside sulfates and polyethoxycarboxylates the cation being an alkali metal (sodium, potassium or lithium), a substituted or unsubstituted ammonium residue (methyl-, dimethyl-, trimethyl- or tetramethylammonium, dimethylpiperidinium, etc.) or an alkanolamine (monoethanolamine, diethanolamine, triethanolamine, etc.) derivative;
- alkyl or alkylaryl phosphate esters such as the products Rhodafac RA600, Rhodafac PA15 or Rhodafac PA23 sold by the company Rhodia.

Among the nonionic surfactants which may be mentioned in particular are alkylene oxide condensates, in particular condensates of ethylene oxide with alcohols, polyols, alkylphenols, fatty acid esters, fatty acid amides and fatty amines; amine oxides, sugar derivatives such as alkylpolyglycosides or fatty acid esters of sugars, in particular sucrose monopalmitate; long-chain tertiary phosphine oxides; dialkyl sulfoxides; block copolymers of polyoxyethylene and of polyoxypropylene; alkoxylated sorbitan esters; fatty esters of sorbitan, poly(ethylene oxides) and fatty acid amides modified so as to give them a hydrophobic nature (for example fatty acid mono- and diethanolamides containing from 10 to 18 carbon atoms).

Mention may be made most particularly of

- polyoxyalkylenated (polyethoxyethylenated, polyoxypropylenated or polyoxybutylenated) alkyl phenols in which the alkyl substituent is $C_6$-$C_{12}$ and containing from 5 to 25 oxyalkylene units; by way of example, mention may be made of Triton X-45, X-114, X-100 or X-102 sold by Rohm & Haas Co.;
- glucosamides, glucamides and glycerolamides;
- polyoxyalkylenated $C_8$-$C_{22}$ aliphatic alcohols containing from 1 to 25 oxyalkylene (oxyethylene or oxypropylene) units. By way of example, mention may be made of Tergitol 15-S-9 and Tergitol 24-L-6 NMW sold by Union Carbide Corp., Neodol 45-9, Neodol 23-65, Neodol 45-7 and Neodol 45-4 sold by Shell Chemical Co., and Rhodasurf IDO60, Rhodasurf LA90 and Rhodasurf IT070 sold by the company Rhodia;
- amine oxides such as ($C_{10}$-$C_{18}$)alkyldimethylamine oxides and ($C_8$-$C_{22}$) alkoxyethyldihydroxyethylamine oxides;
- the alkyl polyglycosides described in U.S. Pat. No. 4,565,647;
- $C_8$-$C_{20}$ fatty acid amides;
- ethoxylated fatty acids;
- ethoxylated amines.

Cationic surfactants are, in particular, alkylammonium salts of formula $R^1R^2R^3R^4N^-X^-$ in which

- $X^-$ represents a halide, $CH_3SO_4^-$ or $C_2H_5SO_4^-$ ion
- $R^1$ and $R^2$ are identical or different and represent a $C_1$-$C_{20}$alkyl radical or an aryl or benzyl radical
- $R^3$ and $R^4$ are identical or different and represent a $C_1$-$C_{20}$ alkyl radical, an aryl or benzyl radical or an ethylene oxide and/or propylene oxide condensate $(CH_2CH_2O)_x$—$(CH_2CHCH_3O)_y$—H, in which x and y are from 0 to 30 and are never both zero, such as cetyltrimethylammonium bromide, Rhodaquat® TFR sold by the company Rhodia.

Examples of zwitterionic surfactants comprise aliphatic quaternary ammonium derivatives, in particular 3-(N,N-dimethyl-N-hexadecylammonio)propane 1-sulfonate and 3-(N,N-dimethyl-N-hexadecylammonio)-2-hydroxypropane 1-sulfonate.

Examples of amphoteric surfactants comprise betaines, sulfobetaines and carboxylates and sulfonates of fatty acids and of imidazole.

The following surfactants are preferred:

- alkyldimethylbetaines, alkylamidopropyldimethylbetaines, alkyldimethylsulfobetaines or alkylamidopropyldimethylsulfobetaines such as Mirataine CBS sold by the company Rhodia, and condensation products of fatty acids and of protein hydrolysates;
- alkylamphoacetates or alkylamphodiacetates in which the alkyl group contains from 6 to 20 carbon atoms
- amphoteric derivatives of alkylpolyamines, such as Amphionic XL® sold by Rhodia and Ampholac 7T/X® and Ampholac 7C/X® sold by Berol Nobel.

Additional examples of suitable surfactants are compounds generally used as surfactants denoted in the well-known manuals "Surface Active Agents", volume I by Schwartz and Perry, and "Surface Active Agents and Detergents", volume II by Schwartz, Perry and Berch.

The surfactants may be present in a proportion of from 0.005% to 60%, in particular from 0.5% to 40%, by weight depending on the nature of the surfactant(s) and on the purpose of the cleaning composition.

Advantageously, the copolymer of general formula I/surfactant weight ratio is between 1/2 and 1/100 and advantageously between 1/5 and 1/50.

In the text hereinbelow, except where otherwise indicated, the proportions are given on a weight basis.

Among the other common additives forming part of the formulation of the detergent compositions, mention may be made of:

in particular for washing in a dishwasher

- organic "builders" (detergent adjuvants for improving the surface properties of surfactants) such as:
  - organic phosphonates, such as those of the range Dequest® from Monsanto (in a proportion of from 0% to 2% relative to the total weight of the detergent composition expressed as solids in the case of a dishwasher composition);
  - polycarboxylic acids or water-soluble salts thereof and water-soluble salts of carboxylic polymers or copolymers, such as
- polycarboxylate or hydroxypolycarboxylate ethers
- polyacetic acids or salts thereof (nitriloacetic acid, N,N-dicarboxymethyl1-2-aminopentane dioic acid, ethylenediaminetetraacetic acid, diethylenetriaminepentaacetic acid, ethylenediaminetetraacetates, nitrilotriacetates such as Nervanaid NTA $Na_3$ sold by the company Rhodia, and N-(2-hydroxyethyl) nitrilodiacetates) (in a proportion of from 0% to 10% relative to the total weight of the detergent composition expressed as solids in the case of a dishwasher composition);
- salts of ($C_5$-$C_{20}$)alkylsuccinic acids
- carboxylic polyacetal esters
- polyaspartic or polyglutamic acid salts
- citric acid, gluconic acid or tartaric acid or salts thereof (in a proportion of from 0% to 10% relative to the total weight of the detergent composition expressed as solids in the case of a dishwasher composition);
- inorganic "builders" (detergent adjuvants for improving the surface properties of surfactants) such as:
  - alkanolamine, ammonium or alkali metal polyphosphates such as Rhodiaphos HPA3.5 sold by the company Rhodia (in a proportion of from 0% to 70% relative to the total weight of detergent composition expressed as solids in the case of a dishwasher composition);
  - alkali metal pyrophosphates
  - zeolites;
  - silicates (in an amount which can be up to 50% approximately relative to the total weight of said detergent composition expressed as solids in the case of a dishwasher composition);
  - alkali metal or alkaline-earth metal borates, carbonates, bicarbonates and sesquicarbonates (in an amount which can be up to 50% approximately relative to the total weight of said detergent composition expressed as solids in the case of a dishwasher composition);

cogranulates of hydrated alkali metal silicates and of alkali metal (sodium or potassium) carbonates, described in EP-A-488 868, such as Nabion 15 sold by the company Rhodia (in an amount which can be up to 50% approximately relative to the total weight of said detergent composition expressed as solids in the case of a dishwasher composition);

(the total amount of organic and/or inorganic "builders" possibly representing up to 90% of the total weight of said detergent composition expressed as solids in the case of a dishwasher composition);

bleaching agents such as perborates or percarbonates, optionally combined with acetylated bleaching activators such as N,N,N',N'-tetraacetylethylenediamine (TAED) or chlorinated products such as chloroisocyanurates, or chlorinated products such as alkali metal hypochlorites (in a proportion of from 0% to 30% relative to the total weight of said detergent composition expressed as solids in the case of a dishwasher composition);

auxiliary cleaning agents such as copolymers of acrylic acid and of maleic anhydride or acrylic acid homopolymers (in a proportion of from 0% to 10% relative to the total weight of said detergent composition expressed as solids in the case of a dishwasher composition);

fillers such as sodium sulfate or sodium chloride, in a proportion of from 0% to 50% relative to the total weight of said composition, expressed as solids;

various other additives, for instance agents which have an influence on the pH of the detergent composition, in particular basifying additives that are soluble in the washing medium (phosphates of alkali metals, carbonates, perborates or hydroxides) or acidifying additives that are soluble in the washing medium (carboxylic or polycarboxylic acids, alkali metal bicarbonates and sesquicarbonates, phosphoric and polyphosphoric acids, sulfonic acids, etc.); or enzymes or fragrances, dyes or metal-corrosion inhibitors;

in particular for doing the washing up by hand synthetic cationic polymers such Mirapol A550® and Mirapol A15® sold by the Rhodia, and Merquat 550® sold by Calgon, polymers used to control the viscosity of the mixture and/or the stability of the foams formed on use, such as cellulose or guar derivatives (carboxymethylcellulose, hydroxyethylcellulose, hydroxypropylguar, carboxymethylguar, carboxymethylhydroxypropyl guar, etc.)

hydrotropic agents, such as $C_2$-$C_8$ short alcohols, in particular ethanol, diols and glycols such as diethylene glycol, dipropylene glycol, etc., moisturizers or wetting agents for the skin, such as glycerol or urea, or skin-protecting agents, such as proteins or protein hydrolysates, and cationic polymers such as cationic guar derivatives (Jaguar C13S®, Jaguar C162® and Hicare 1000® sold by the company Rhodia).

The compositions according to the invention can be diluted (in water) from 1 to 10,000 times, preferably from 1 to 1000 times, before use.

The cleaning composition according to the invention is applied to the surface to be treated in an amount such that it allows, where appropriate after rinsing, and after drying, a deposition of copolymer according to the invention of from 0.0001 g/m$^2$ to 1 g/m$^2$, preferably 0.001 g/m$^2$ to 0.1 g/m$^2$ of surface to be treated.

According to one preferred embodiment of the invention, the copolymer described above is used for doing the washing up by hand or in an automatic machine, to give the washing-up crockery hydrophilic properties as described above. In this latter case, said copolymer can be present either in the detergent formulation used in the washing cycle, or in the rinsing liquid.

Detergent formulations for doing the washing up in automatic dishwashers advantageously comprise from 0.1% to 5% and preferably 0.2% to 3% by weight of water-soluble or water-dispersible copolymer relative to the total weight of solids in the composition.

The detergent dishwasher compositions also comprise at least one surfactant, preferably a nonionic surfactant, in an amount ranging from 0.2% to 10% and preferably from 0.5% to 5% relative to the weight of said detergent composition expressed as solids, the remainder consisting of various additives and fillers, as already mentioned above. These formulations generally comprise 30% to 95% of a builder agent chosen from silicates, phosphates and carbonates. They also comprise an oxidizing system, which is introduced to a content of between 3% and 25%.

Formulations for rinsing washing-up crockery in an automatic dishwasher advantageously comprise from 0.02% to 10% and preferably from 0.1% to 5% by weight of copolymer relative to the total weight of the composition.

They also comprise from 0.5% to 20% and preferably from 0.5% to 15% by weight, relative to the total weight of said composition, of a surfactant, preferably a nonionic surfactant or a mixture of nonionic and anionic surfactant.

Among the preferred nonionic surfactants which may be mentioned are surfactants such as polyoxyethylenated $C_6$-$C_{12}$ alkoylphenols, polyoxyethylenated and/or polyoxypropylenated $C_8$-$C_{22}$ aliphatic alcohols, ethylene oxide/propylene oxide block copolymers, optionally polyoxyethylenated carboxylic amides, etc.

They also comprise from 0% to 10% and preferably from 0.5% to 5% by weight, relative to the total weight of the composition, of a calcium-sequestering organic acid, preferably citric acid.

They can also comprise an auxiliary agent such as a copolymer of acrylic acid and of maleic anhydride or acrylic acid homopolymers, in a proportion of from 0% to 15% and preferably from 0.5% to 10% by weight relative to the total weight of said composition.

A subject of the invention is also the use of the polymer according to the invention in a cleaning composition for doing the washing up by hand.

Preferred detergent formulations of this type comprise from 0.1 part to 5 parts by weight of copolymer of the invention per 100 parts by weight of said composition and contain from 3 to 50 parts, preferably from 10 to 40 parts, by weight of at least one surfactant, preferably an anionic surfactant, chosen in particular from saturated $C_5$-$C_{24}$, preferably $C_{10}$-$C_{16}$, aliphatic alkyl sulfates, optionally condensed with approximately 0.5 mol to 30 mol, preferably 0.5 mol to 5 mol and most particularly 0.5 mol to 3 mol, of ethylene oxide, in acid form or in the form of a salt, in particular an alkali metal (sodium), alkaline-earth metal (calcium, magnesium), etc. salt.

The present invention is directed more particularly toward foaming liquid aqueous detergent formulations for doing the washing up by hand.

Said formulations can also contain other additives, in particular other surfactants, such as:

- nonionic surfactants such as amine oxides, alkylglucamides, oxyalkylenated derivatives of fatty alcohols, alkylamides, alkanolamides and amphoteric or zwitterionic surfactants,
- non-cationic bactericides or disinfectants such as triclosan
- synthetic cationic polymers
- polymers for controlling the viscosity of the mixture and/or the stability of the foams formed on use
- hydrotropic agents
- moisturizers or wetting agents or skin protectors
- dyes, fragrances, preserving agents, etc. as already mentioned above.

The copolymer according to the invention is also useful for treating glass panels. This treatment can be carried out by means of the various known techniques. Mention may be made in particular of the techniques for cleaning glass panels by spraying them with a jet of water using machines of Karcher® type.

The amount of polymer introduced will generally be such that, during the use of the cleaning composition, after optional dilution, the concentration is between 0.001 g/l and 2 g/l, preferably from 0.005 g/l to 0.5 g/l.

The composition for cleaning glass panels according to the invention comprises:

- from 0.001% to 10% and preferably from 0.005% to 3% by weight of at least one water-soluble or water-dispersible copolymer as defined above;
- from 0.005% to 20% and preferably from 0.5% to 10% by weight of at least one nonionic (for example an amine oxide) and/or anionic surfactant; and
- the remainder being formed of water and/or various additives that are common in the field.

The cleaning formulations for glass panels comprising said polymer can also contain:

- from 0% to 10% and advantageously from 0.5% to 5% of amphoteric surfactant,
- from 0% to 30% and advantageously from 0.5% to 15% of solvent such as alcohols, and the remainder consisting of water and common additives (in particular fragrances).

Another subject of the invention consists in using a polymer as defined above for external cleaning, in particular of the bodywork, of motor vehicles.

In this case also, the copolymer according to the invention can be present either in a detergent formulation used for the washing operation, or in a rinsing product.

The cleaning composition for motor vehicles advantageously comprises from 0.05% to 5% by weight of copolymer according to the invention relative to the total weight of said composition, as well as:

- nonionic surfactants (in a proportion of from 0% to 30% and preferably from 0.5% to 15% of the formulation),
- amphoteric and/or zwitterionic surfactants (in a proportion of from 0% to 30% and preferably from 0.5% to 15% of the formulation)
- cationic surfactants (in a proportion of from 0% to 30% and preferably from 0.5% to 15% of the formulation);
- anionic surfactants (in a proportion of from 0% to 30% and preferably from 0.5% to 15% of the formulation);
- organic or inorganic detergent adjuvants ("builders");
- hydrotropic agents;
- fillers, pH regulators, etc.

The minimum amount of surfactant present in this type of composition can be at least 1% of the formulation. The copolymer of the invention is also particularly suitable for cleaning hard surfaces other than those described above, in particular ceramics (tiles, baths, sinks, etc.).

In this case, the cleaning formulation advantageously comprises from 0.02% to 5% by weight of copolymer relative to the total weight of said composition, as well as at least one surfactant.

Surfactants that are preferred are nonionic surfactants, in particular the compounds produced by condensation of alkylene oxide groups as described above which are of hydrophilic nature with a hydrophobic organic compound which may be of aliphatic or alkyl aromatic nature.

The length of the hydrophilic chain or of the polyoxyalkylene radical condensed with any hydrophobic group may easily be adjusted to obtain a water-soluble compound which has the desired degree of hydrophilic/hydrophobic balance (HLB).

The amount of nonionic surfactants in the composition of the invention is generally from 0% to 30% by weight and preferably from 0% to 20% by weight.

An anionic surfactant may optionally be present in an amount of from 0% to 30% and advantageously 0% to 20% by weight.

It is also possible, but not obligatory, to add amphoteric, cationic or zwitterionic detergents to the composition of the present invention for cleaning hard surfaces.

The total amount of surfactant compounds used in this type of composition is generally between 1.5% and 50% and preferably between 5% and 30% by weight, and more particularly between 10% and 20% by weight, relative to the total weight of the composition.

The composition for cleaning hard surfaces of the present invention can also contain other minor ingredients which are cleaning additives.

For example, the composition can contain organic or inorganic detergent adjuvants ("builders") as mentioned above.

The detergent adjuvant is generally used in an amount of between 0.1% and 25% by weight relative to the total weight of the composition.

Another optional ingredient in the compositions for cleaning hard surfaces of the invention is a foam regulator, which can be used in compositions which have a tendency to produce an excess of foam during their use. One example of these materials is soaps. Soaps are salts of fatty acids and comprise alkali metal soaps, in particular the sodium, potassium, ammonium and alkanolammonium salts of higher fatty acids containing from about 8 to 24 carbon atoms, and preferably from about 10 to about 20 carbon atoms. The salts of mono-, di- and triethanolamine, of sodium and of potassium or of mixtures of fatty acids derived from coconut oil and from ground walnut oil are particularly useful. The amount of soap may be at least 0.005% by weight, preferably from 0.5% to 2% by weight, relative to the total weight of the composition. Additional examples of foam regulators are organic solvents, hydrophobic silica, silicone oil and hydrocarbons.

The compositions for cleaning hard surfaces of the present invention can also contain, besides the ingredients mentioned above, other optional ingredients such as pH regulators, dyes, optical brighteners, soil-suspending agents, detergent enzymes, compatible bleaching agents, gel-formation regulators, freezing-thawing stabilizers, bactericides, preserving agents, solvents, fungicides, insect repellents, hydrotropic agents, fragrances and opacifiers or pearlescent agents.

The polymer of the invention can also be used for cleaning toilet pans.

One composition which is particularly suitable for this purpose comprises from 0.05% to 5% by weight of copolymer according to the invention.

The composition for cleaning toilet pans according to the invention also comprises an acidic cleaning agent which can consist of an inorganic acid such as phosphoric acid, sulfamic acid, hydrochloric acid, hydrofluoric acid, sulfuric acid, nitric acid or chromic acid and mixtures thereof, or an organic acid, in particular acetic acid, hydroxyacetic acid, adipic acid, citric acid, formic acid, fumaric acid, gluconic acid, glutaric acid, glycolic acid, malic acid, maleic acid, lactic acid, malonic acid, oxalic acid, succinic acid and tartaric acid, as well as mixtures thereof, and acid salts such as sodium bisulfate, and mixtures thereof.

The amount of acidic ingredients is preferably between 0.1% and about 40% and more preferably between 0.5% and about 15% by weight relative to the total weight of the composition.

The preferred amount depends on the type of acidic cleaning agent used: for example, with sulfamic acid it is between about 0.2% and about 1%, with hydrochloric acid it is between about 1% and about 5%, with citric acid it is between about 2% and about 10%, with formic acid it is between about 5% and about 15%, and with phosphoric acid it is between about 5% and about 30% by weight.

The amount of acidic agent is generally such that the final pH of the composition is from about 0.5 to about 4, preferably 1 to 3.

The cleaning composition for toilet pans also comprises from 0.5% to 10% by weight of a surfactant so as to contribute toward removing soiling or so as to give foaming or wetting properties or alternatively to enhance the cleaning efficacy of the composition. The surfactant is preferably an anionic or nonionic surfactant.

Cationic surfactants can also be added to the composition for cleaning toilet pans according to the invention, in order to provide germicidal properties. A person skilled in the art will see that amphoteric surfactants can also be used. Mixtures of various surfactants can be used, if so desired.

The composition for cleaning toilet pans according to the invention can also comprise a thickener such as a gum, in particular a xanthan gum introduced at a concentration of from 0.1% to 3%, as well as one or more of the following minor ingredients: a preserving agent intended to prevent the growth of microorganisms in the product, a dye, a fragrance and/or an abrasive agent.

The polymer according to the invention is also suitable for rinsing the walls of showers.

The aqueous compositions for rinsing the walls of showers comprise from 0.02% to 5% by weight and advantageously from 0.05% to 1% of the copolymer of the invention.

The other main active components of the aqueous compositions for rinsing showers of the present invention are at least one surfactant present in an amount ranging from 0.5% to 5% by weight and optionally a metal-chelating agent present in an amount ranging from 0.01% to 5% by weight.

The preferred metal-chelating agents are ethylenediaminetetraacetic acid (EDTA) and its analogues.

The aqueous compositions for rinsing showers advantageously contain water, optionally with at least one lower alcohol in a majority proportion and additives in a minority proportion (between about 0.1% and about 5% by weight, more advantageously between about 0.5% and about 3% by weight and even more preferably between about 1% and about 2% by weight).

Certain surfactants which can be used in this type of application are described in U.S. Pat. Nos. 5,536,452 and 5,587,022, the content of which is incorporated by reference in the present description.

Preferred surfactants are polyethoxylated fatty esters, for example polyethoxylated sorbitan monooleates and polyethoxylated castor oil. Specific examples of such surfactants are the products of condensation of 20 mol of ethylene oxide and of sorbitan monooleate (sold by Rhodia Inc. under the name Alkamuls PSMO-20® with an HLB of 15.0) and 30 mol or 40 mol of ethylene oxide and of castor oil (sold by Rhodia Inc. under the name Alkamuls EL-620® (HLB of 12.0) and EL-719® (HLB of 13.6), respectively). The degree of ethoxylation is preferably sufficient to obtain a surfactant with an HLB of greater than 13. Other surfactants such as alkylpolyglucosides are also suitable for these compositions.

The polymer according to the invention can also be used for cleaning glass-ceramic plates.

The formulations for cleaning glass-ceramic plates of the invention advantageously comprise:

- 0.05% to 5% by weight of the copolymer of the invention;
- 0.1% to 1% by weight of a thickener such as a xanthan gum;
- 10% to 40% by weight of an abrasive agent such as calcium carbonate or silica;
- 0% to 7% by weight of a glycol such as butyl diglycol;
- 1% to 10% by weight of a nonionic surfactant;
- 0.1% to 3% by weight of a copolymer of silicone type; and
- optionally, basifying agents or sequestering agents.

A subject of the invention is also the use of a water-soluble or water-dispersible copolymer as defined above for cleaning a hard surface, in particular for giving a hard surface hydrophilic properties.

The hydrophilic properties-given by the copolymer of the invention are, in particular, "run-resistance", "anti-misting", "stain-resistance"and/or "mark-resistance"properties.

A subject of the invention is also the use, in a liquid cleaning composition for a hard surface, of at least one water-soluble or water-dispersible copolymer of the invention, as an agent for reducing the drying speed of the surface onto which said liquid composition has been applied.

A subject of the invention is similarly a process for improving the hydrophilicity of a hard surface, by treating said surface using a cleaning composition comprising at least one copolymer of the invention.

A subject of the invention is also a process for improving the drying speed of a hard surface after it has been cleaned with a cleaning composition, by incorporating at least one copolymer of the invention into said composition.

The examples below are intended to illustrate the invention.

EXAMPLES 1 TO 3 AND COMPARATIVE EXAMPLES 4 TO 6

Preparation of Copolymers of the Invention

Copolymers of the formula below are prepared as previously:

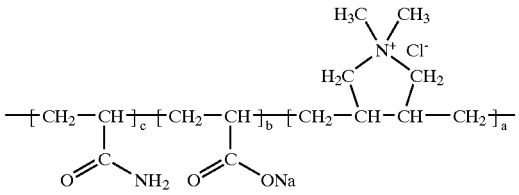

| Reference | a/b ratio | c/b/a ratio |
|---|---|---|
| Polymer 1 | 50/50 | 2/4/4 |
| Polymer 2 | 25/75 | 3/3/1 |
| Polymer 3 | 50/50 | 1/1/1 |
| Polymer 4 (comp) | 100/0 | 4/0/6 |
| Polymer 5 (comp) | 80/20 | 0/2/8 |
| Polymer 6 (comp) | 100/0 | 0/0/1 |
| Polymer 7 | 33/66 | 0/2/1 |

The copolymers of Examples 1 to 3 and of the Comparative Examples 4 to 6 are evaluated as regards their ability to give a glass plate hydrophilic properties.

Evaluation Method

A glass surface consisting of microscope slides 2.5×7.5 cm in size, precleaned with ethanol. are used, the composition of which slides is given below:

| | |
|---|---|
| Si | 21–43% by weight |
| Ca | 2.8–5.8% by weight |
| Mg | 1.6–3.4% by weight |
| Na | 6.8–14.2% by weight |
| Al | 0.3–0.7% by weight |

The test polymer is dissolved in demineralized water containing 0.5 g/l of Symperonic A7 nonionic surfactant from BASF, at a concentration of 0.5 g/l or 0.1 g/l and the pH is adjusted, by adding sodium hydroxide, to pH=9.

The solution of polymer and of surfactant is deposited on a glass slide using a centrifugal applicator with:

deposition of the solution of polymer and of surfactant onto the glass slide;

rotation of the glass slide at 1500 rpm for 30 seconds.

A contact angle measurement can then be carried out on the treated slide in order to obtain a so-called "without rinsing" result. The so-called "with rinsing" result requires the following additional steps:

immersing the glass slide in purified water for 15 seconds;

drying the slide by rotation with the rotary applicator, for 30 seconds at 1500 rpm.

The contact angle between the water and the treated glass is measured on a Ramé-Hart assembly and is expressed in degrees. Eight to ten measurements are taken per glass slide. Two to three glass slides are prepared for each polymer and the results thus correspond to the average of 20 to 30 measurements.

The contact angle obtained on a slide which has undergone the treatment described with an aqueous solution (demineralized water) without polymer gives a contact angle of 16°.

The values before rinsing give information regarding the hydrophilic or hydrophobic nature of the polymer. However, the most interesting data corresponds to the contact angle after rinsing, which characterizes both the hydrophilicity and the force of the polymer/glass interactions. For the application in cleaning hard surfaces, a low value of this contact angle with rinsing is desired. A polymer with a contact angle of less than 12° and most particularly less than 10° will give good performance qualities in the abovementioned applications.

The results obtained are given in the table below:

| Example | Contact angle 0.1 g/l before rinsing | Contact angle 0.1 g/l after rinsing | Contact angle 0.5 g/l before rinsing | Contact angle 0.5 g/l after rinsing |
|---|---|---|---|---|
| 1 | 16.7 ± 1.0 | 17 ± 0.8 | 10.8 ± 1.0 | 6.8 ± 1.1 |
| 2 | 13 ± 0.6 | 12.8 ± 1.1 | 7.2 ± 0.8 | 6.3 ± 1.0 |
| 3 | 15 ± 0.7 | 13.5 ± 0.9 | 7.6 ± 0.8 | 10.9 ± 0.9 |
| 4 (comparative) | 20.9 ± 0.5 | 22.9 ± 1.3 | 19.7 ± 1.1 | 21.4 ± 1.3 |
| 5 (comparative) | 19.5 ± 0.8 | 20.2 ± 0.5 | 20.3 ± 0.8 | 21.4 ± 1.2 |
| 6 (comparative) | 23.3 ± 1.4 | 20.4 ± 2.4 | 24.1 ± 1.4 | 23. ± 1.2 |

These examples show that the polymers of the invention give surfaces long-lasting hydrophilicity when the a/b ratio is less than 60/40. This is not the 5 case for the comparative polymers, which have an a/b ratio of greater than 60/40.

EXAMPLES 7 TO 9

Cleaning Formulations for Cleaning Glass Panels

The table below reports the composition of three cleaning formulations used for cleaning glass panels:

| | Formulations (by weight) | | |
|---|---|---|---|
| Components | Example 7 | Example 8 | Example 9 |
| Isopropyl alcohol | 7 | 7 | 15 |
| Ethoxylated (7 EO) fatty alcohol (C12) | 0 | 0 | 3 |
| Sodium dodecylbenzene sulfonate | 0.5 | 0.5 | 0 |
| Ammonium hydroxide | 0.3 | 0.3 | 0.3 |
| Dipropylene glycol monomethyl ether | 0.25 | 0.25 | 0.5 |
| Copolymer of Example 1 | 0.05 | 0.5 | 1 |
| Water | qs 100 | qs 100 | qs 100 |

The formulations of Examples 7 to 9 are used without further modification, by spraying them onto the surface of the glass panels to be cleaned (6 to 8 sprays, i.e. 3 to 5 g of formulation per $m^2$ of surface)

EXAMPLES 10 AND 11

Cleaning Formulations for Hard Surfaces Such as Tiles, Ceramics, Sinks and Baths The table below gives cleaning formulations for cleaning hard surfaces.

| Components | Formulations (by weight) Example 10 | Example 11 |
|---|---|---|
| Ethoxylated (7 EO) fatty alcohol (C12) | 6 | 8 |
| Sodium alkyl (C12) sulfonate | 3 | 2 |
| Sodium hydroxide | such that pH = 10.4 | such that pH = 10.4 |
| Copolymer of Example 2 | 1 | 0.5 |
| Water | qs 100 | qs 100 |

The formulations of Examples 10 and 11 are diluted before use, to a rate of 10 g of formulation in 1 litre of water.

EXAMPLES 12 TO 15

Detergent Formulation for Automatic Dishwashers

A base detergent formulation is prepared from the compounds given in the table below:

| Formulation example | Example 12 | Example 13 | Example 14 | Example 15 |
|---|---|---|---|---|
| Sodium tripolyphosphate | 0 | 0 | 60 | 35 |
| Sodium carbonate | 35 | 30 | 0 | 20 |
| Sodium disilicate | 20 | 15 | 23 | 10 |
| Sodium citrate | 20 | 15 | 0 | 0 |
| Sodium sulfate | 0 | 20 | 0 | 19 |
| Sodium polyacrylate CP5 from BASF | 6 | 5 | 0 | 0 |
| Plurafac LF 403 | 2 | 1 | 2 | 2 |
| Bleaching system (perborate · 1 $H_2O$ + TAED**) | 12 | 10 | 10 | 10 |
| Other additives (including benzotriazole, enzymes, fragrance) | 3 | 3 | 3 | 3 |
| Polymer 7 | 2 | 1 | 2 | 1 |

EXAMPLES 16 TO 18

Formulations for Rinsing Washing-Up Crockery in an Automatic Dishwasher

| Formulation | Example 16 | Example 17 | Example 18 |
|---|---|---|---|
| C13—3P0—7E0 nonionic surfactant (EO/PO linear fatty alcohol) | 12 | 12 | 12 |
| Citric acid | 3 | 3 | 3 |
| Polymer | Polymer 1 (2%) | Polymer 2 (2%) | Polymer 7 (2%) |
| Water | qs 100 | qs 100 | qs 100 |

EXAMPLES 19 AND 20

Formulation for Doing Washing Up by Hand

| Formulation | Example 19 | Example 20 |
|---|---|---|
| Sodium alkyl sulfonate (C14) | 24 | 12 |
| Ethoxylated C12 fatty alcohol-1.5 EO | 5 | 3 |
| Ethoxylated C10 fatty alcohol-7 EO | 4 | 4 |
| Polymer | Polymer 1 (2%) | Polymer 7 (2%) |
| Water | qs 100 | qs 100 |

EXAMPLES 21 AND 22

Detergent Formulations for Cleaning Hard Surfaces (Tiles, Sinks, Baths)

| Formulation | Example 21 | Example 22 |
|---|---|---|
| Sodium alkyl sulfonate (C12) | 24 | 12 |
| Ethoxylated C12 fatty alcohol-6 EO | 5 | 3 |
| Ethanol | 4 | 4 |
| Polymer | Polymer 3 (2%) | Polymer 1 (2%) |
| Water | qs 100 | qs 100 |

What is claimed is:

1. A method for giving external surface of motor vehicles long-lasting stain-resistant or mark-resistant properties using a liquid cleaning composition applied onto said surface, comprising the step of adding to said composition an efficient amount of a water-soluble or water-dispersible copolymer comprising, in the form of polymerized units:

(a) at least one monomer compound of general formula I:

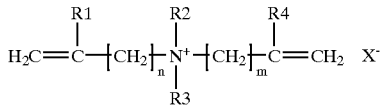

wherein:

$R_1$ and $R_4$, independently of each other, represent a hydrogen atom or a linear or branched C1-C6 alkyl group;

$R_2$ and $R_3$, independently of each other, represent an alkyl, hydroxyalkyl or aminoalkyl group wherein the alkyl group is a linear or branched $C_1$-C6 chain;

n and m are integers between 1 and 3; and

X, which are identical or different, represent counterions which are compatible with the water-soluble or water-dispersible nature of the polymer;

(b) at least one hydrophilic monomer bearing a function of acidic nature which is copolymerizable with (a) and capable of ionizing in the application medium, and (c) optionally, at least one hydrophilic monomer compound containing ethylenic unsaturation and of neutral charge, bearing one or more hydrophilic groups, which is copolymerizable with (a) and (b); and wherein the a/b molar ratio is between 50/50 and 10/90, the composition comprising:

from 0.1% to 5% by weight relative to the total weight of said composition of the water-soluble or water-dispersible copolymer, from 0% to 30% relative to the weight of the formulation, of at least one nonionic surfactant;

from 0% to 30% relative to the weight of the formulation, of at least one anionic surfactant;

from 0% to 30% by weight of an amphoteric or zwitterionic surfactant;

from 0% to 30% by weight of a cationic surfactant;

the minimum amount of surfactant being at least 1%;

from 0% to 50 relative to the weight of the formulation, of an inorganic or organic detergent adjuvant; and optionally, a hydrotropic agent, fillers and pH regulators.

2. A method for giving toilet pans long-lasting stain-resistant or mark-resistant properties using a liquid cleaning composition applied onto said surface, comprising the step of adding to said composition an efficient amount of a water-soluble or water-dispersible copolymer comprising, in the form of polymerized units:

(a) at least one monomer compound of general formula 1:

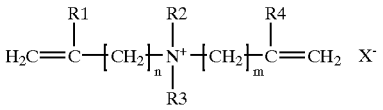

wherein:

$R_1$ and $R_4$, independently of each other, represent a hydrogen atom or a linear or branched $C_1$,-$C_6$ alkyl group;

R2 and R3, independently of each other, represent an alkyl, hydroxyalkyl or aminoalkyl group wherein the alkyl group is a linear or branched C1-$C_6$ chain;

n and mare integers between 1 and 3; and

X, which are identical or different, represent counterions which are compatible with the water-soluble or water-dispersible nature of the polymer;

(b) at least one hydrophilic monomer bearing a function of acidic nature which is copolymerizable with (a) and capable of ionizing in the application medium, and (c) optionally, at least one hydrophilic monomer compound containing ethylenic unsaturation and of neutral charge, bearing one or more hydrophilic groups, which is copolymerizable with (a) and (b); and wherein the a/b molar ratio is between 50/50 and 10/90, the composition comprising:

from 0.05% to 5% by weight of water-soluble or water-dispersible copolymer from0.1%to4O%3 relative to the total weight of the composition, of an acid cleaning agent selected from phosphoric acid, sulfamic acid, hydrochloric acid, hydrofluoric acid, sulfuric acid, nitric acid -chromic acid acetic acid, hydroxyacetic acid, adipic acid, citric acid, formic acid, fumaric acid, gluconic acid, glutaric acid, glycolic acid, malic acid, maleic acid, lactic acid, malonic acid, oxalic acid, succinic acid and tartaric acid;

from 0.5% to 10% by weight of a surfactant from 0.1% to 3% by weight of a thickener.

3. A method for giving shower walls long-lasting stain-resistant or mark-resistant properties using a liquid cleaning composition applied onto said surface, comprising the step of adding to said composition an efficient amount of a water-soluble or water-dispersible copolymer comprising, in the form of polymerized units:

(a) at least one monomer compound of general formula I:

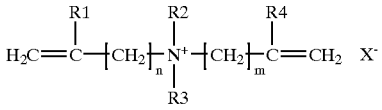

wherein:

$R_1$ and $R_4$, independently of each other, represent a hydrogen atom or a linear or branched $C_1$-$C_6$ alkyl group;

$R_2$ and $R_3$, independently of each other, represent an alkyl, hydroxyalkyl or aminoalkyl group wherein the alkyl group is a linear or branched $C_1$-C6 chain;

n and m are integers between 1 and 3; and

X, which are identical or different, represent counterions which are compatible with the water-soluble or water-dispersible nature of the polymer;

(b) at least one hydrophilic monomer bearing a function of acidic nature which is copolymerizable with (a) and capable of ionizing in the application medium, and (c) optionally, at least one hydrophilic monomer compound containing ethylenic unsaturation and of neutral charge, bearing one or more hydrophilic groups, which is copolymerizable with (a) and (b); and wherein the a/b molar ratio is between 50/50 and 10/90, the composition fw6her comprising:

from 0.05% to 5% by weight of water-soluble or water-dispersible copolymer from 0.5% to 5% by weight of a nonionic surfactant;

optionally, from 0.01% to 5% by weight of a metal-chelating agent.

4. A method according to claim 2, wherein the acid cleaning agent is in the form of an acid salt.

5. A method according to claim 2, wherein the surfactant is anionic or non-ionic.

6. A method according to claim 2, wherein the thickener is agum or a xanthan gum.

7. A method according to claim 2, further comprising a preserving agent intended to prevent the growth of microorganisms, a dye, a fragrance or an abrasive agent.

8. A method according to claim 3, wherein the nonionic surfactant is a polyethoxylated fatty acid ester or an alkylpolyglucoside.

* * * * *